US007210582B2

(12) United States Patent
Riddle

(10) Patent No.: US 7,210,582 B2
(45) Date of Patent: May 1, 2007

(54) SCREEN AND SCREEN FRAME FOR IMPROVED SCREEN TO SHAKER PLACEMENT, HANDLING AND RETENTION

(75) Inventor: Russell Riddle, Williamstown, KY (US)

(73) Assignee: M-I L.L.C., Houston, TX (US)

( * ) Notice: Subject to any disclaimer, the term of this patent is extended or adjusted under 35 U.S.C. 154(b) by 160 days.

(21) Appl. No.: 10/839,505

(22) Filed: May 5, 2004

(65) Prior Publication Data

US 2005/0247604 A1 Nov. 10, 2005

(51) Int. Cl.
*B07B 1/46* (2006.01)

(52) U.S. Cl. ..... 209/408; 209/412

(58) Field of Classification Search ..... 209/399, 209/403, 405, 408, 412
See application file for complete search history.

(56) References Cited

U.S. PATENT DOCUMENTS

| | | | | |
|---|---|---|---|---|
| 966,578 | A * | 8/1910 | Seale et al. | 209/403 |
| 1,314,547 | A * | 9/1919 | Sturtevant | 209/403 |
| 2,455,383 | A * | 12/1948 | Pickard | 209/323 |
| 4,870,728 | A * | 10/1989 | Nelson | 28/271 |
| 5,006,228 | A * | 4/1991 | Anderson et al. | 209/365.3 |
| 5,598,931 | A * | 2/1997 | Hosogoshi et al. | 209/405 |
| 5,811,003 | A * | 9/1998 | Young et al. | 210/388 |
| 6,439,392 | B1 * | 8/2002 | Baltzer | 209/405 |
| 2005/0103689 | A1 * | 5/2005 | Schulte et al. | 209/405 |
| 2005/0258080 | A1 * | 11/2005 | Carr et al. | 209/399 |

OTHER PUBLICATIONS

PCT Application No. PCT/US05/1634; International Search Report dated Jun. 28, 2006 (4 pages).

* cited by examiner

*Primary Examiner*—Joseph C. Rodriguez

(57) ABSTRACT

A frame for a screen utilized in a shaker separator, the frame including: a first (2) and a second (4) longitudinal support member (2) spaced apart from and substantially parallel to the each other; one or more inner longitudinal support member (6), positioned between and substantially parallel to the outer longitudinal support members; a first (8) and a second (10) outer lateral support member (8), each being connected and substantially perpendicular to a corresponding outer longitudinal support member; a third outer lateral support member (12), connected and substantially perpendicular to the second outer longitudinal support member; a fourth outer lateral support member (14), connected and substantially perpendicular to the second outer longitudinal support member; one or more inner lateral support member (16), positioned between and substantially perpendicular to the first outer longitudinal support member and the second outer longitudinal support member and connected to the one or more inner longitudinal support member; a first lateral support brace (18), one end of which is connected to the first outer lateral support member and the other end of which is connected to the second end of the third outer lateral support member; a second lateral support brace (20), one end of which is connected to the second outer lateral support member and the other end of which is connected to fourth outer lateral support member.

13 Claims, 2 Drawing Sheets

SCREEN AND SCREEN FRAME FOR IMPROVED SCREEN TO SHAKER PLACEMENT, HANDLING AND RETENTION

BACKGROUND

Rotary drilling methods employing a drill bit and drill stems have long been used to drill wellbores in subterranean formations. Drilling fluids or muds are commonly circulated in the well during such drilling to cool and lubricate the drilling apparatus, lift drilling cuttings out of the wellbore, and counterbalance the subterranean formation pressure encountered. The recirculation of the drilling mud requires the fast and efficient removal of the drilling cuttings and other entrained solids from the drilling mud prior to reuse. Shaker separators are commonly used to remove the bulk solids from the drilling mud. An essential element of the shaker separators are the shaker screens. Shaker screens are typically composed of a support frame and screen (either pretensioned or perforated plate screen) assemblies. As is illustrated in FIG. 2 the current state of the art method for securing the shaker screen (22) to the shaker separator (not fully shown) involves the use of a wedge block clamp (24) which is an integral part of the shaker separator and a wedge block (26). As one of skill in the art should know, the screen is placed in position underneath the wedge block clamp and then the wedge block is pounded into position so as to secure the screen to the shaker separator. Unfortunately, the shaking motion of the shaking separator can cause the loosening of the wedge block and thus the loosening of the screen vis-à-vis the shaker separator. Thus there exists a continuing need for improved designs in the support frames for shaker screens that improve the placement and retention of the screen to the shaker.

SUMMARY OF THE CLAIMED SUBJECT MATTER

The present disclosure is generally directed to a support frame for a shaker screen (1), the frame includes a first outer longitudinal support member (2), a second outer longitudinal support member (4), which is spaced apart from and substantially parallel to the first outer longitudinal support member and one or more inner longitudinal support member (6), each of which is positioned between and substantially parallel to the first outer longitudinal support member and the second outer longitudinal support member. A first outer lateral support member (8) is connected to the one end of the first outer longitudinal support member and is substantially perpendicular to the first outer longitudinal support member. A second outer lateral support member (12) is connected to the other end of the first outer longitudinal support member is substantially perpendicular to the first outer longitudinal support member. Similarly a third outer lateral support member (10), and a fourth lateral support member (14) are connected to the second outer longitudinal support member both of which are substantially perpendicular to the second outer longitudinal support member. The screen frame also includes one or more inner lateral support member which is positioned between and substantially perpendicular to the first outer longitudinal support member and the second outer longitudinal support member and which are connected to the one or more inner longitudinal support members. A first lateral support brace (18), is connected to the first and third outer lateral support members. Similarly, a second lateral support brace (20), is connected to the second and fourth outer lateral support members.

In one illustrative embodiment, the support frame is designed such that the first lateral support brace and the second lateral support brace are positioned to form a wedge block clamping platform on the lateral edge of the support frame. In one preferred embodiment, the wedge block clamping platform is positioned and has a width such that it corresponds substantially to the width of the wedge block thereby enhancing screen clamping to the shaker.

Alternatively or in addition, an illustrative embodiment of the support frame is designed such that the combination of the first lateral support brace and the first and third outer lateral support members form a gripping element on the lateral end of the support frame. Similarly, the combination of the second lateral support brace and the second and fourth outer lateral support members form a gripping element on the lateral end of the support frame. When used in combination with each other, the pairs of gripping elements can be used to obtain a firm grip on the screen frame using a human hand or by using a gripping tool, such a gripping hook. The gripping element is preferably positioned and sized such that the support frame, and thus the shaker screen, can be easily gripped for positioning prior to securing to the shaker separator.

Additional details and information regarding the claimed subject matter can be found in the following description.

DESCRIPTION OF THE FIGURES

The present disclosure is made with reference to the following Figures.

DESCRIPTION OF THE CLAIMED SUBJECT MATTER

Figure 1:
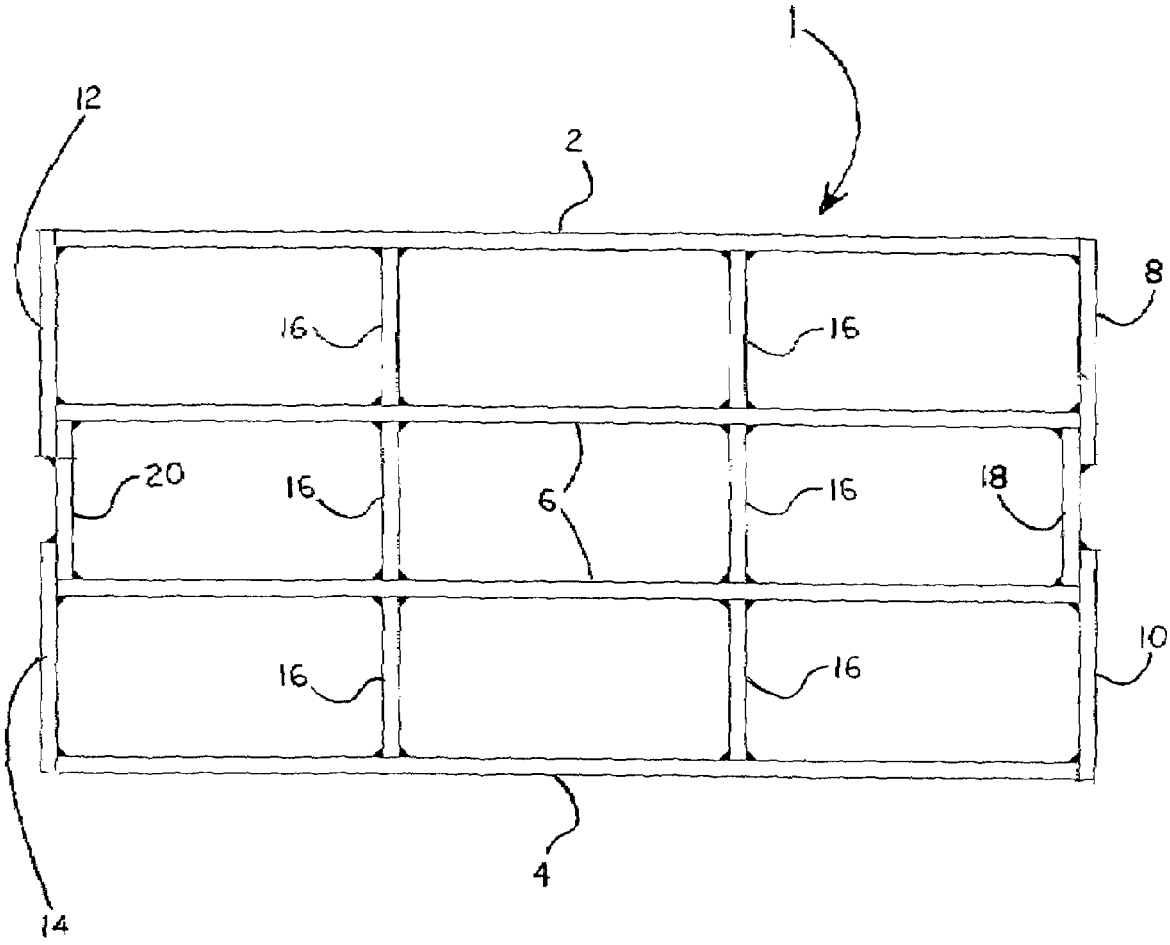
FIG. 1, is a top view of an illustrative embodiment of a shaker screen frame as disclosed herein.

The present disclosure is generally directed to a support frame for a shaker screen and a shaker screen incorporating such a frame. With reference to FIG. 1, one illustrative embodiment of a frame for a shaker screen (1) of the present invention includes, a first outer longitudinal support member (2), and a second outer longitudinal support member (4), spaced apart from and substantially parallel to the other. It will be appreciated by one of skill in the art that all of the support members, unless noted otherwise, inherently have a first end and a second end. The frame also includes one or more inner longitudinal support member (6), each being positioned between and substantially parallel to the first outer longitudinal support member and the second outer longitudinal support member.

The frame further includes a first outer lateral support member (8), substantially perpendicular to the first outer longitudinal support member. One end of the first outer lateral support frame is connected to the first end of the first outer longitudinal support member. A second outer lateral support member (12), is connected to the second end of the first outer longitudinal support member and is substantially perpendicular to the first outer longitudinal support member. The other end of the support frame preferably mirrors that just described. That is to say, a third outer lateral support member (10), is connected to the other end of and is substantially perpendicular to the second outer longitudinal support member. Similarly a fourth outer lateral support member (14), is connected to the second end of the second outer longitudinal support member in a substantially perpendicular manner. The frame further is composed of one or more inner lateral support member (16) each of which is positioned between and substantially perpendicular to the first outer longitudinal support member and the second outer longitudinal support member. As shown in FIG. 1, at least one end of each of the one or more inner lateral support member is connected to the one or more inner longitudinal support member. A first lateral support brace (18) has a first half end and a second half end. The first lateral support brace is connected at one half end to the second end of the first outer lateral support member; and at the other half end is connected to the second end of the third outer lateral support member. Similarly, a second lateral support brace (20) has a first half end and a second half end. The second lateral support brace at one half end is connected to the second end of the second outer lateral support member; and at the other half end is connected to the second end of the fourth outer lateral support member. As shown in FIG. 1, the above forms a support frame for a shaker screen upon which screening or filtering elements may be supported. As is further shown in FIG. 1, the positioning of the lateral support braces and the outer lateral support members can be used to form a pair of gripping elements on the lateral sides of the screen frame. Such gripping elements may be of a sufficient size and design to be gripped by a human hand to assist in the handling of the screen frame. Alternatively, the gripping elements can be sized and designed to be gripped by a gripping tool. Such a gripping tool may be a conventional cargo hook or may be a specially designed tool having a handle and an engaging portion designed to engage the gripping element. Regardless of the gripping tool utilized, the concept is to provide the user the ability to securely and safely grip the screen frame so that it can be handled and positioned as needed.

Figure 2:
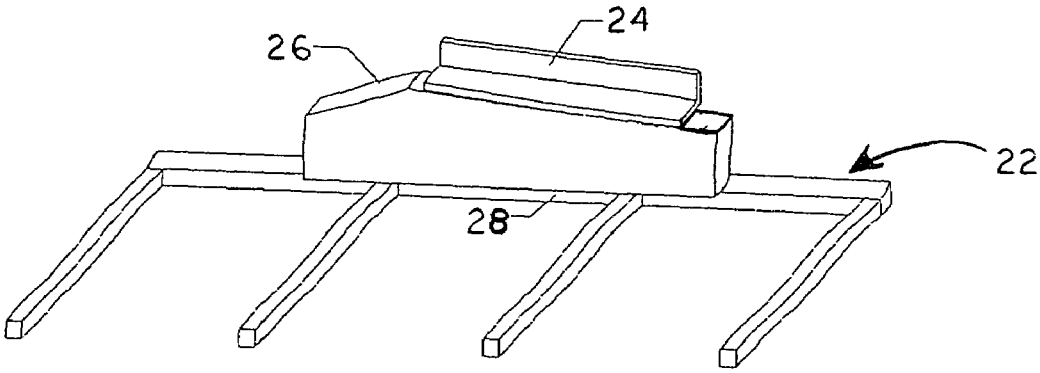
(PRIOR ART) FIG. 2
FIG. 2 is a diagram illustrating the interactions of a state of the art (prior art) screen frame with a wedge block and a wedge block retaining bracket of a shaker separator.
Figure 3:
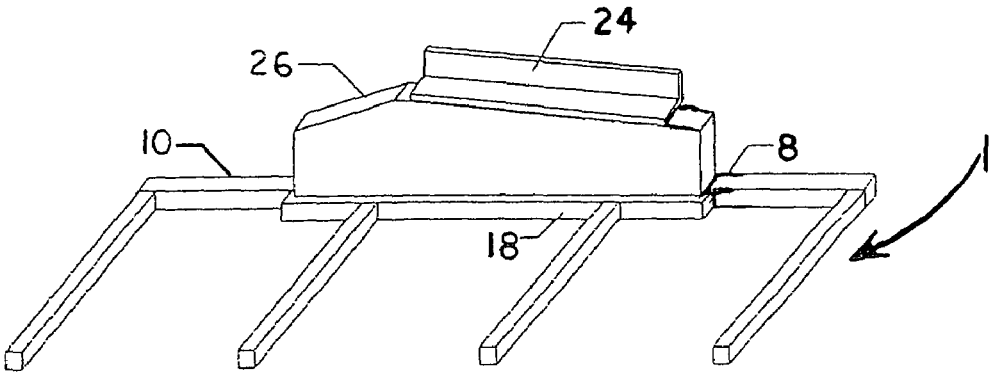
FIG. 3 is a diagram illustrating the interactions of a screen frame as disclosed herein with a wedge block and a wedge clock retaining bracket of a shaker separator.

One of the many features of the present illustrative embodiment includes the ability to increases the contact surface area between the wedge block and the screen frame. As is illustrated in FIG. 2 the current state of the art method for securing the shaker screen (22) to the shaker separator (not fully shown) involves the use of a wedge block clamp (24) which is an integral part of the shaker separator and a wedge block (26). As one of skill in the art should know, the screen is placed in position underneath the wedge block clamp and then the wedge block is positioned so as to secure the screen to the shaker separator. Unfortunately, the shaking motion of the shaking separator can cause the loosening of the wedge block and thus result in the loosening of the screen vis-à-vis the shaker separator. In contrast and as is shown in FIG. 3, the present illustrative embodiment of the present invention includes a combination of the two outer lateral support members (8 & 10) and the lateral support brace (18) form an increased contact surface area (not shown) for the wedge block (26). This increased contact surface area substantially increases the frictional contact between the wedge block and the shaker screen. One of skill in the art should immediately appreciate that such an arrangement increases the static frictional energy required to loosen the wedge block during the shaking process. Further it will be appreciated that the positioning of the wedge block serves to seal any gap in the screen formed by the presence of any gripping element without decreasing the effective surface area of the shaker screen.

One of skill in the art should understand and appreciate that a wide variety of materials may be utilized for the construction of the above described frame. In one such illustrative embodiment, the frame is constructed of welded metal, such as steel, steel alloys, aluminum, aluminum alloys, and the like which may subsequently be coated with paint, epoxy, thermoplastic and other such protective materials. Alternatively, the frame may be constructed from composite materials including resin based composites, such as: fiberglass/resin; carbon fiber/resin; metal fiber/resin; combinations of these and the like, thermoplastic composites such as fiberglass/plastic; carbon fiber/plastic; metal fiber/plastic; combinations of these and the like; as well as combinations of various composite materials that are suitable for such applications. Finally it should be noted that one of skill in the art would appreciate that the illustrative frames may be cast, stamped, forged, or machined from ferrous and non-ferrous metals, plastics, composite materials and the like.

Structurally the frame is preferably made of a tubular material and more preferably all of the components of the frame are substantially made from a tubular material. In one illustrative embodiment, the tubular material is selected from square tubular material, rectangular tubular material, round tubular material, combinations of these and other materials that should be known to one of skill in the art.

Formation of a shaker screen utilizing the frames described above should be well known to one of skill in the art. In general, screen elements, which may or may not be pre-tensioned, are secured to the frame. This securing step may be any conventional means taking into account the composition of the frame and the composition and nature of the screen.

In view of the above, one of skill in the art should appreciate that one illustrative embodiment of the present invention includes a shaker screen (1), having one or more screen layers supported by a frame in which the improvement includes the frame as substantially described herein. Further, it should be appreciated that the present invention also includes a conventional shaker separator having one or more shaker screens, in which each of the shaker screens has one or more screen layer supported by a frame, the improvement including the frame as substantially described herein. Finally it should be appreciated that the present invention encompasses the use of the frames as substantially described herein in the separation of materials on a shaker separator.

While the apparatus, compositions and methods disclosed above have been described in terms of preferred or illustrative embodiments, it will be apparent to those of skill in the art that variations may be applied to the process described herein without departing from the concept and scope of the claimed subject matter. All such similar substitutes and modifications apparent to those skilled in the art are deemed to be within the scope and concept of the subject matter as it is set out in the following claims.

What is claimed is:

1. A support frame for a shaker screen (1), the frame comprising:

a first outer longitudinal support member (2), wherein the first outer longitudinal support member has a first end and a second end;

a second outer longitudinal support member (4), wherein the second outer longitudinal support member has a first end and a second end, and wherein the second outer longitudinal support member is spaced apart from and substantially parallel to the first outer longitudinal support member;

one or more inner longitudinal support member (6), wherein each of the one or more inner longitudinal support member has a first end and a second end, and wherein each of the one or more inner longitudinal support member is positioned between and substantially parallel to the first outer longitudinal support member and the second outer longitudinal support member;

a first outer lateral support member (8), wherein the first outer lateral support member has a first end and a second end, and wherein the first end of the first outer lateral support member is connected to the first end of the first outer longitudinal support member, and wherein the first outer lateral support member is substantially perpendicular to the first outer longitudinal support member;

a second outer lateral support member (12), wherein the second outer lateral support member has a first end and a second end, and wherein the first end of the second outer lateral support member is connected to the second end of the first outer longitudinal support member, and wherein the second outer lateral support member is substantially perpendicular to the first outer longitudinal support member;

a third outer lateral support member (10), wherein the third outer lateral support member has a first end and a second end, and wherein the first end of the third outer lateral support member is connected to the first end of the second outer longitudinal support member, and wherein the third outer lateral support member is substantially perpendicular to the second outer longitudinal support member;

a fourth outer lateral support member (14), wherein the fourth outer lateral support member has a first end and a second end, and wherein the first end of the fourth outer lateral support member is connected to the second end of the second outer longitudinal support member, and wherein the fourth outer lateral support member is substantially perpendicular to the second outer longitudinal support member;

one or more inner lateral support member (16), wherein each of the one or more inner lateral support member has a first end and a second end, and wherein each of the one or more inner lateral support member is positioned between and substantially perpendicular to the first outer longitudinal support member and the second outer longitudinal support member, and wherein at least the first or second end of each of the one or more inner lateral support member is connected to the one or more inner longitudinal support member;

a first lateral support brace (18), wherein the first lateral support brace has a first half end and a second half end, and wherein the first half end of the first lateral support brace is located inward of and connected to the second end of the first outer lateral support member, and wherein the second half end of the first lateral support brace is located inward of and connected to the second end of the third outer lateral support member; and a second lateral support brace (20), wherein the second lateral support brace has a first half end and a second half end, and wherein the first half end of the second lateral support brace is located inward of and connected to the second end of the second outer lateral support member, and wherein the second half end of the second lateral support brace is located inward of and connected to the second end of the fourth outer lateral support member;

wherein the one or more inner longitudinal support member is spaced apart from the first and second outer longitudinal support member;

wherein the one or more inner lateral support member is spaced apart from and substantially parallel to the first, second, third, and fourth outer lateral support members; and wherein material passing through the shaker screen passes through the spaces formed between the inner and outer longitudinal support members and the inner and outer lateral support members.

2. The support frame of claim 1, wherein a wedge block clamping platform having substantially the width of a corresponding wedge block is formed by the inward location of the first lateral support brace relative to the first outer lateral support member and the third outer lateral support member and by the inward location of the second lateral support brace relative to the second outer lateral support member and the fourth outer lateral support member.

3. The support frame of claim 1, wherein the first lateral support brace and the second lateral support brace are made from a square tubular material.

4. The support frame of claim 1, wherein the first and second outer longitudinal support members and the first, second, third and fourth outer lateral support members are made from a square tubular material.

5. The support frame of claim 1, wherein all of the components of the frame are substantially made from a tubular material.

6. The support frame of claim 5, wherein the tubular material is selected from the group consisting of square tubular material and round tubular material.

7. The support frame of claim 5, wherein the tubular material is selected from the group consisting of metal, metal alloys, polymers, polymer composite materials, carbon fiber composite materials, glass fiber composite materials, and combinations thereof.

8. The support frame of claim 5, wherein the tubular material is selected from the group consisting of steel, steel alloys, aluminum, aluminum alloys and combinations thereof.

9. The support frame of claim 1, wherein a pair of gripping elements are defined by the inward location of the first lateral support brace with respect to the first and third outer lateral support members and the inward location of the second lateral support brace with respect to the second and fourth outer lateral support members.

10. The support frame of claim 9, wherein the pair of gripping elements are designed to be gripped by a human hand.

11. The support frame of claim 9, wherein the pair of gripping elements are designed to be gripped by a gripping tool.

12. A shaker screen (1), comprising one or more screen layers supported by a frame, wherein the improvement comprises the frame including:

a first outer longitudinal support member (2), wherein the first outer longitudinal support member has a first end and a second end;

a second outer longitudinal support member (4), wherein the second outer longitudinal support member has a first end and a second end, and wherein the second outer longitudinal support member is spaced apart from and substantially parallel to the first outer longitudinal support member;

one or more inner longitudinal support member (6), wherein each of the one or more inner longitudinal support member has a first end and a second end, and wherein each of the one or more inner longitudinal support member is positioned between and substantially parallel to the first outer longitudinal support member and the second outer longitudinal support member;

a first outer lateral support member (8), wherein the first outer lateral support member has a first end and a second end and wherein the first end of the first outer lateral support member is connected to the first end of the first outer longitudinal support member, and wherein the first outer lateral support member is substantially perpendicular to the first outer longitudinal support member;

a second outer lateral support member (12), wherein the second outer lateral support member has a first end and a second end, and wherein the first end of the second outer lateral support member is connected to the second end of the first outer longitudinal support member, and wherein the second outer lateral support member is substantially perpendicular to the first outer longitudinal support member;

a third outer lateral support member (10), wherein the third outer lateral support member has a first end and a second end, and wherein the first end of the third outer lateral support member is connected to the first end of the second outer longitudinal support member, and wherein the third outer lateral support member is substantially perpendicular to the second outer longitudinal support member;

a fourth outer lateral support member (14), wherein the fourth outer lateral support member has a first end and a second end, and wherein the first end of the fourth outer lateral support member is connected to the second end of the second outer longitudinal support member, and wherein the fourth outer lateral support member is substantially perpendicular to the second outer longitudinal support member;

one or more inner lateral support member (16), wherein each of the one or more inner lateral support member has a first end and a second end, and wherein each of the one or more inner lateral support member is positioned between and substantially perpendicular to the first outer longitudinal support member and the second outer longitudinal support member, and wherein at least the first or second end of each of the one or more inner lateral support member is connected to the one or more inner longitudinal support member;

a first lateral support brace (18), wherein the first lateral support brace has a first half end and a second half end, and wherein the first half end of the first lateral support brace is located inward of and connected to the second end of the first outer lateral support member, and, wherein the second half end of the first lateral support brace is located inward of and connected to the second end of the third outer lateral support member; and a second lateral support brace (20), wherein the second lateral support brace has a first half end and a second half end, and wherein the first half end of the second lateral support brace is located inward of and connected to the second end of the second outer lateral support member, and wherein the second half end of the second lateral support brace is located inward of and connected to the second end of the fourth outer lateral support member;

wherein the one or more inner longitudinal support member is spaced apart from the first and second outer longitudinal support member;

wherein the one or more inner lateral support member is spaced apart from and substantially parallel to the first, second, third, and fourth outer lateral support members; and wherein material passing through the one or more screening layers passes through the spaces formed between the inner and outer longitudinal support members and the inner and outer lateral support members.

13. A shaker separator, wherein the shaker separator includes means for distributing the flow of material to be separated, one or more separator screens, and one or more means for shaking the one or more separator screens, the improvement comprising a frame including:

a first outer longitudinal support member (2), wherein the first outer longitudinal support member has a first end and a second end;

a second outer longitudinal support member (4), wherein the second outer longitudinal support member has a first end and a second end; and, wherein the second outer longitudinal support member is spaced apart from and substantially parallel to the first outer longitudinal support member;

one or more inner longitudinal support member (6), wherein each of the one or more inner longitudinal support member has a first end and a second end; and, wherein each of the one or more inner longitudinal support member is positioned between and substantially parallel to the first outer longitudinal support member and the second outer longitudinal support member;

a first outer lateral support member (8), wherein the first outer lateral support member has a first end and a second end; and, wherein the first end of the first outer lateral support member is connected to the first end of the first outer longitudinal support member; and, wherein the first outer lateral support member is substantially perpendicular to the first outer longitudinal support member;

a second outer lateral support member (12), wherein the second outer lateral support member has a first end and a second end, and wherein the first end of the second outer lateral support member is connected to the second end of the first outer longitudinal support member, and wherein the second outer lateral support member is substantially perpendicular to the first outer longitudinal support member;

a third outer lateral support member (10), wherein the third outer lateral support member has a first end and a second end, and wherein the first end of the third outer lateral support member is connected to the first end of the second outer longitudinal support member, and wherein the third outer lateral support member is substantially perpendicular to the second outer longitudinal support member;

a fourth outer lateral support member (14), wherein the fourth outer lateral support member has a first end and a second end, and wherein the first end of the fourth outer lateral support member is connected to the second end of the second outer longitudinal support member, and wherein the fourth outer lateral support member is substantially perpendicular to the second outer longitudinal support member;

one or more inner lateral support member (16), wherein each of the one or more inner lateral support member has a first end and a second end, and wherein each of the one or more inner lateral support member is positioned between and substantially perpendicular to the first outer longitudinal support member and the second outer longitudinal support member, and wherein at least the first or second end of each of the one or more inner lateral support member is connected to the one or more inner longitudinal support member;

a first lateral support brace (18), wherein the first lateral support brace has a first half end and a second half end, and wherein the first half end of the first lateral support brace is located inward of and connected to the second end of the first outer lateral support member, and wherein the second half end of the first lateral support brace is located inward of and connected to the second end of the third outer lateral support member;

a second lateral support brace (20), wherein the second lateral support brace has a first half end and a second half end, and wherein the first half end of the second lateral support brace is located inward of and connected to the second end of the second outer lateral support member, and wherein the second half end of the second lateral support brace is located inward of and connected to the second end of the fourth outer lateral support member;

wherein the one or more inner longitudinal support member is spaced apart from the first and second outer longitudinal support member;

wherein the one or more inner lateral support member is spaced apart from and substantially parallel to the first, second, third, and fourth outer lateral support members; and wherein material passing through the one or more separator screens passes through the spaces formed between the inner and outer longitudinal support members and the inner and outer lateral support members.

* * * * *